United States Patent [19]

Bernier

[11] 4,138,180

[45] Feb. 6, 1979

[54] PLUG

[75] Inventor: Raymond Bernier, Vincennes, France

[73] Assignee: Bernier et Cie, Paris, France

[21] Appl. No.: 872,182

[22] Filed: Jan. 25, 1978

[51] Int. Cl.[2] ..... H01R 13/38

[52] U.S. Cl. ..... 339/95 R; 339/176 M; 339/195 M

[58] Field of Search ..... 339/64 R, 64 M, 95 R, 339/176 R, 176 M, 195, 196

[56] References Cited

U.S. PATENT DOCUMENTS 3,747,050 7/1973 Hecht ..... 339/195 M

*Primary Examiner*—Gerald A. Dost

*Attorney, Agent, or Firm*—William Anthony Drucker

[57] ABSTRACT

The invention relates to a plug of the kind comprising a first element having at least one pin, and a second element having at least one socket designed to take the pin. The improvement is that the pin is cylindrical in shape and has an enlarged end, ogival in shape, and the socket has a square-section hole, the diameter of the circle inscribed in the hole being substantially equal to the maximum diameter of the swollen end of the pin.

3 Claims, 4 Drawing Figures

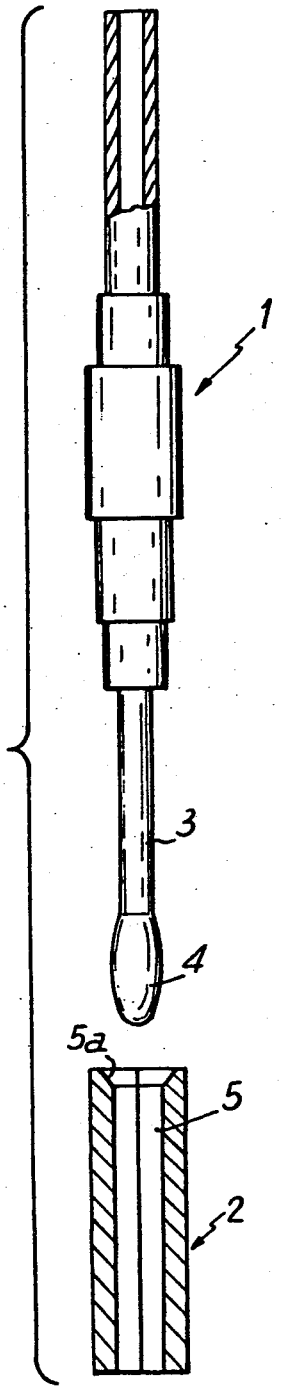
Fig:2
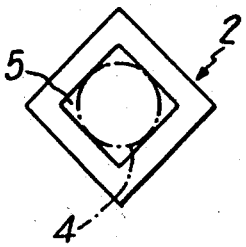
Fig:3
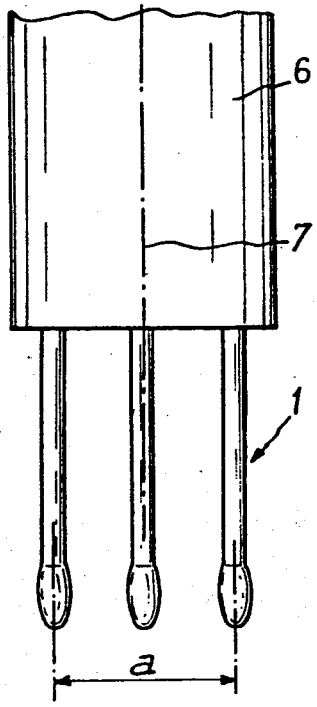
Fig:4
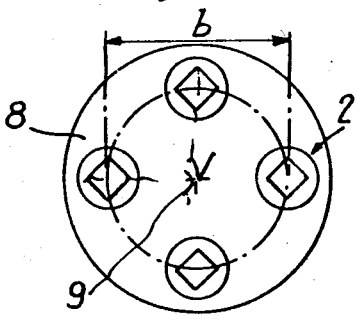

PLUG

The present invention relates to plugs of the kind comprising a first element equipped with at least one pin, and a second element equipped with at least one socket designed to take the pin.

BACKGROUND OF THE INVENTION

Plugs are already known wherein the pins are tangentially in contact with split sockets, but these plugs often have faults which are detrimental to the good quality of the equipment. Thus, for example, in the case of contacts made by turning and milling, the male pin is more or less damaged by arcing inside the split socket, which in particular remove the electrolytic coating of the pin.

OBJECT OF THE INVENTION

The object of the present invention is to provide improvements in plugs, with a view to overcoming this drawback.

SUMMARY OF THE INVENTION

According to the present invention, the pin is cylindrical in shape and has an enlarged end, ogival in shape, the socket having a square-section hole, the diameter of the circle inscribed in this hole being substantially equal to the maximum diameter of the enlarged end of the pin.

When, as is usually the case, the plug comprises several pins and several sockets, the pins are preferably positioned differently from the sockets, so that plugging-in causes the pins to bend. This bending creates pressure between the pins and the sockets and ensures that they are self-cleaning. If one of the pins has a slight slant, its enlarged end ensures that it is straightened and penetrates correctly inside the socket.

When the axes of the pins and sockets are positioned in a cylinder or several concentric cylinders, the square-section hole of each of the sockets preferably has two of its opposite corners orientated towards the axis of the cylinder(s) and the difference in positioning is obtained by arranging the pins in a cylinder whose diameter is slightly different from that of the cylinder in which the corresponding sockets are arranged. In these circumstances, when plugging in, each socket rubs on two generating lines of the corresponding pin, and this friction though very gentle provides excellent contact pressure.

The invention is partiuularly applicable to sub-ouncer miniaturised plugs.

BRIEF DESCRIPTION OF THE DRAWINGS

A description is given below, by way of non-limiting example, of an embodiment of the improved plug according to the present invention, with reference to the accompanying drawing wherein:

FIG. 1 is an elevation of a pin and its socket;

FIG. 2 is a sectional view of the socket;

FIG. 3 is an elevation of the male element of the plug;

FIG. 4 is a view from above of the female element.

DESCRIPTION OF THE PREFERRED EMBODIMENT

As shown in the drawing, the plug according to the invention includes at least one pin 1 and one socket 2.

Pin 1 includes a cylindrical part 3 which ends in a part 4 which is slightly enlarged and ogival in shape. Socket 2 comprises a hole 5 whose section is square, the radius of the circle inscribed in this hole having a diameter substantially equal to the maximum diameter of the ogival end 4 of pin 1. The end of hole 5 facing towards the pin is chamfered, as shown at 5*a*, so as to facilitate guiding and penetration of this pin.

FIGS. 3 and 4 show a plug comprising several contacts. The male element of the plug consists of a holder 6 in which pins 1 are mounted, these being four in number in the example shown and having their axes situated on the same cylinder axis 7 whose diameter is a. The female element consists of a base 8 carrying sockets 2. These are arranged on the axial cylinder 9 whose diameter is b in such a way that two opposite edges of hole 5 are orientated towards axis 9. Moreover, the positioning diameter b of sockets 2 is slightly different from the positioning diameter a of pins 1, this difference in diameter being greater than the play resulting from assembly, i.e. in the case of four contacts, double the play existing between the ogival part 4 of a pin and the hole 5 in a socket 2. Plugging the male element of the plug into the female element thus causes bending, ensuring pressure and self-cleaning of the contacts. Firm contact and efficient pressure are thus obtained between the various elements of the plug, each socket being in contact with the corresponding pin along two generating lines.

The invention is not limited to the embodiment described and shown, but covers variants within the scope of the appended claims.

I claim:

1. In a plug of the kind comprising a first element having at least one pin and a second element having at least one socket designed to take the pin, the improvement that the pin is cylindrical in shape and has an enlarged ogival end, the socket having a square-section hole, the diameter of the circle inscribed in said hole being substantially equal to the maximum diameter of the enlarged end of the pin.

2. A plug, according to claim 1, comprising a plurality of pins and a plurality of sockets, arranged so that plugging in causes bending of the pins.

3. A plug, according to claim 2, in which the axes of the pins and the sockets are arranged selectively on a cylinder and on a plurality of concentric cylinders, and wherein the square-section hole of each of the sockets has two of its opposite corners orientated towards the axis of the cylinder(s), the different positioning being obtained by arranging the pins in a cylinder whose diameter is slightly different from that of the cylinder in which the corresponding sockets are arranged.

* * * * *